US005868018A

United States Patent [19]

Kang

[11] Patent Number: 5,868,018

[45] Date of Patent: Feb. 9, 1999

[54] DOOR LOCK

[75] Inventor: Eui Shik Kang, Daegu, Rep. of Korea

[73] Assignee: Hyundae Metal Co., Ltd., Daegu, Rep. of Korea

[21] Appl. No.: 917,427

[22] Filed: Aug. 26, 1997

[30] Foreign Application Priority Data

Aug. 26, 1996 [KR] Rep. of Korea ..... 1996-26383

[51] Int. Cl.[6] ..... E05B 13/10

[52] U.S. Cl. ..... 70/472; 70/149; 70/223; 70/224; 70/422

[58] Field of Search ..... 70/188, 189, 204, 70/149, 221–224, 218, 422, 472; 292/359, DIG. 27

[56] References Cited

U.S. PATENT DOCUMENTS

| | | | |
|---|---|---|---|
| 1,804,781 | 5/1931 | Keeler | 292/DIG. 27 X |
| 3,368,375 | 2/1968 | Russell et al. | 70/149 |
| 3,621,685 | 11/1971 | Sargent | 70/422 X |
| 3,922,896 | 12/1975 | Kagoura | 70/218 X |
| 3,955,387 | 5/1976 | Best et al. | 70/224 |
| 4,838,053 | 6/1989 | Shen | 70/224 X |
| 5,010,752 | 4/1991 | Lin | 70/472 X |
| 5,018,375 | 5/1991 | Tully | 70/472 |
| 5,040,391 | 8/1991 | Lin | 70/472 X |
| 5,372,025 | 12/1994 | Lin | 70/472 |

*Primary Examiner*—Lloyd A. Gall

*Attorney, Agent, or Firm*—Jacobson, Price, Holman & Stern, PLLC

[57] ABSTRACT

A door lock comprises: a spindle with projections; a bushing having grooves which mate with the projections of the spindle, and a key groove on one side thereof; an inside inner spindle with two fitting grooves, which is inserted into the spindle and rotates by an operation shaft of a key box; a locking spring which is inserted into the inside inner spindle; an inside outer spindle which is inserted, spaced a short distance from the inside inner spindle, having two guide apertures, a latch operation projection with an operation groove, and two fitting projections on its front end, which are fitted in the fitting grooves; a support washer which is inserted into the inside of the inside outer spindle; a spindle spring which is supported by the support washer; an operation disk with two guide projections which are inserted into the guide apertures of the inside outer spindle; and an operation key which is inserted into the key groove of the bushing so that its front end is inserted into the operation groove of the inside outer spindle. Accordingly the present invention can prevent damage to the door lock and its break downs that may occur when opening the secured door lock by force from the outside.

1 Claim, 3 Drawing Sheets

DOOR LOCK

BACKGROUND OF THE INVENTION

1. Field of the Invention

The present invention relates to a door lock. More particularly, it relates to a door lock of which an outside lever does nothing but rotate at a specified angle as if the door lock is not secured, not letting a door be opened actually, when the outside lever is turned to open the door while the door lock is being secured, thereby preventing damage to the door lock and its break downs that may occur when opening the secured door lock by force from the outside.

2. Discussion of Related Art

In a conventional cylindrical door lock, once a locking button is pressed from the inside, its outside lever is not turned in a manner that the door is not opened from the outside. Frequently, we try to turn the lever, not knowing that the door is being locked, and as the lever does not move, we may turn the lever by force, misunderstanding that the door is not opened since the lever is not turned.

In case we try to open the door being locked without a key, we over and over again turn the lever to the right and left, though we know that the door is being locked. This causes internal devices to be either abraded and break down, or hang down, thus marring the external appearance of the door.

I also have a Korean Utility Model Application No. 94-27710 which has been already published, in which a small locking piece of a floating plate transmits force in case of operating the lever. This conventional door lock has a problem of early abrasion and break downs for lack of solidity of structure, and the complicated manufacturing process increases the overall production costs.

SUMMARY OF THE INVENTION

Accordingly, the present invention is directed to a door lock that substantially obviates one or more of the problems due to limitations and disadvantages of the related art.

An object of the present invention is to provide a door lock of which an outside lever does nothing but rotate at a specified angle as if the door lock is not secured, not letting a door be opened actually, when the lever is turned to open the door while the door lock is being secured.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the door lock comprises: a spindle 2 with projections 3; a bushing 5 having grooves 4 which mate with the projections 3 of the spindle 2, and a key groove 6 on one side thereof; an inside inner spindle 9 with two fitting grooves 8, which is inserted into the spindle 2 and rotates by an operation shaft 35 of a key box 34; a locking spring 12 which is inserted into the inside inner spindle 9; an inside outer spindle 13 which is inserted, spaced a short distance from the inside inner spindle 9, having two guide apertures 19, a latch operation projection 23 with an operation groove 24, and two fitting projections 14 on its front end, which are fitted in the fitting grooves 8; a support washer 15 which is inserted into the inside of the inside outer spindle 13; a spindle spring 16 which is supported by the support washer 15; an operation disk 17 with two guide projections 18 which are inserted into the guide apertures 19 of the inside outer spindle 13; and an operation key 25 which is inserted into the key groove 6 of the bushing 5 so that its front end is inserted into the operation groove 24 of the inside outer spindle 13.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Figure 1:
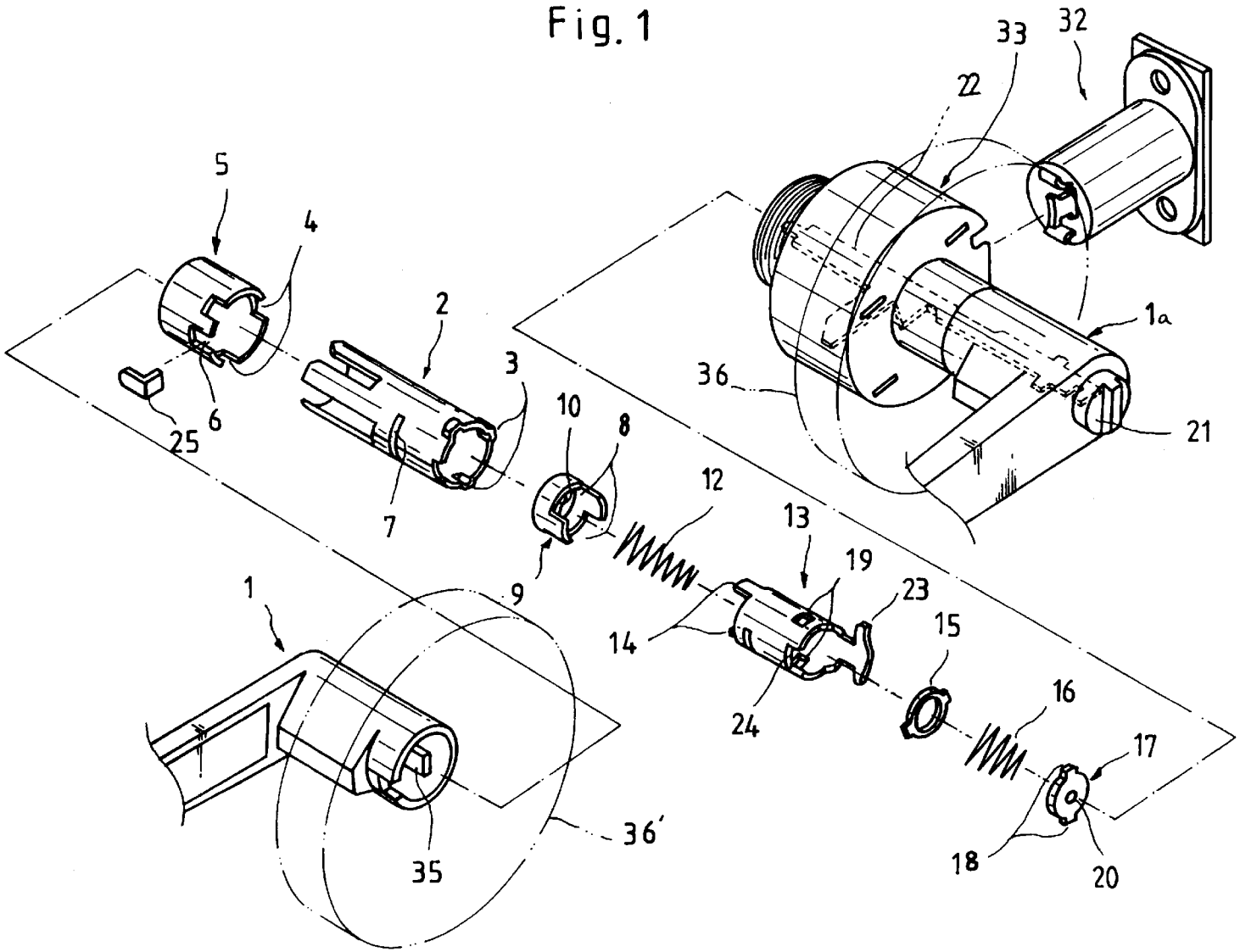
FIG. 1 is an exploded-perspective view of main parts of the present invention.
Figure 2:
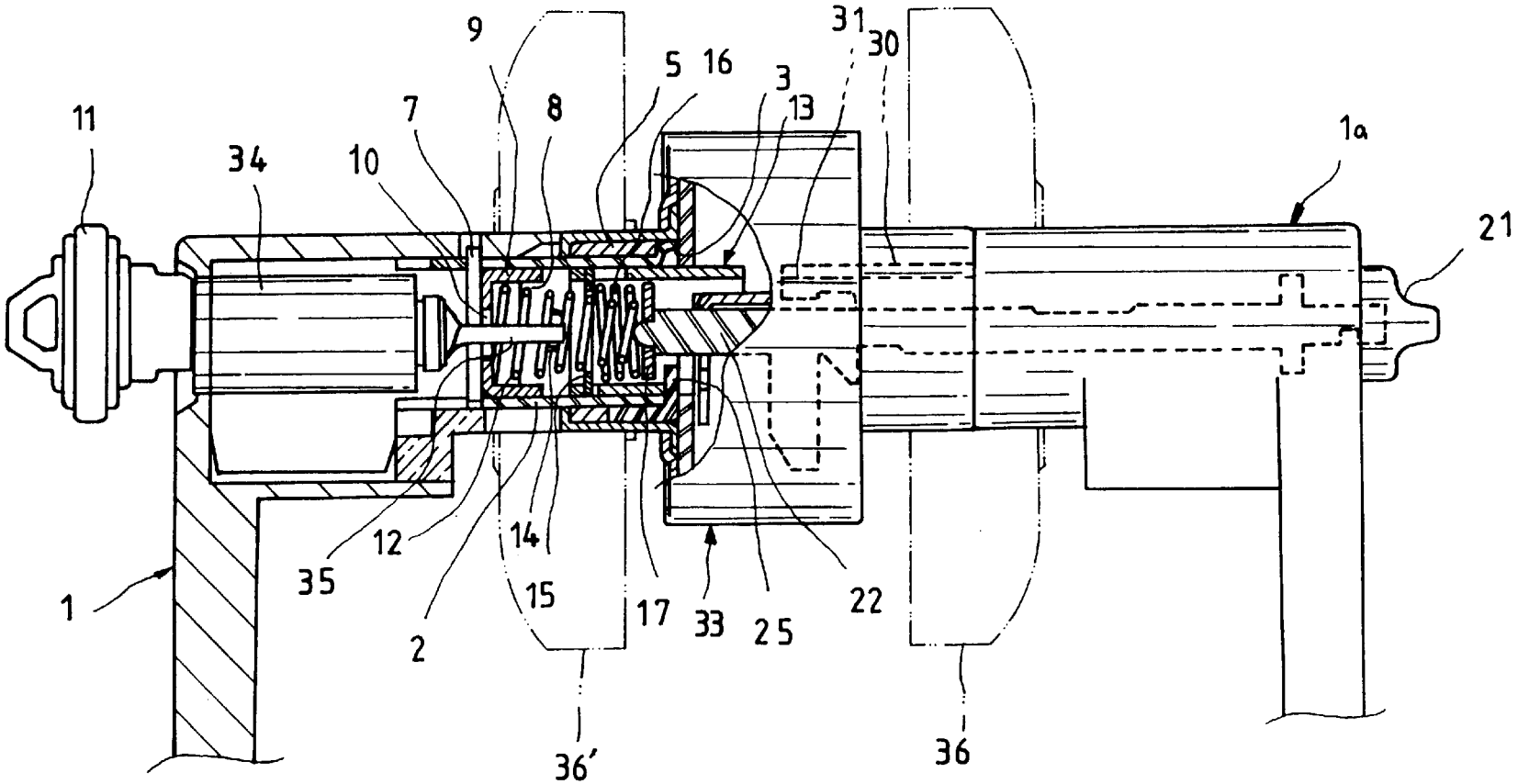
FIG. 2 is a cross-sectional view of the main parts showing a coupling state of the present invention.
Figure 4:
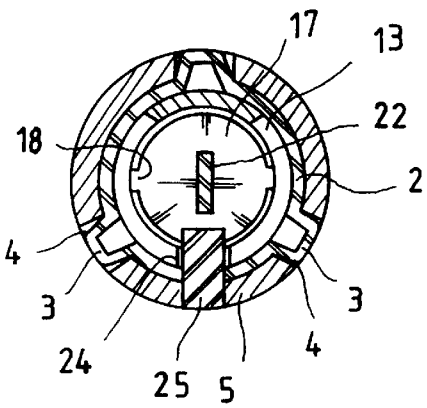
FIG. 4 is a cross-sectional view as taken along line 4—4 of FIG. 3.
Figure 5:
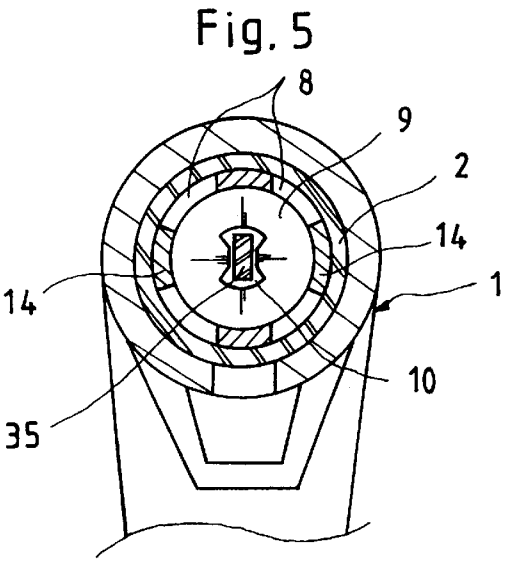
FIG. 5 is a cross-sectional view as taken along line 5—5 of FIG. 3.
Figure 3:
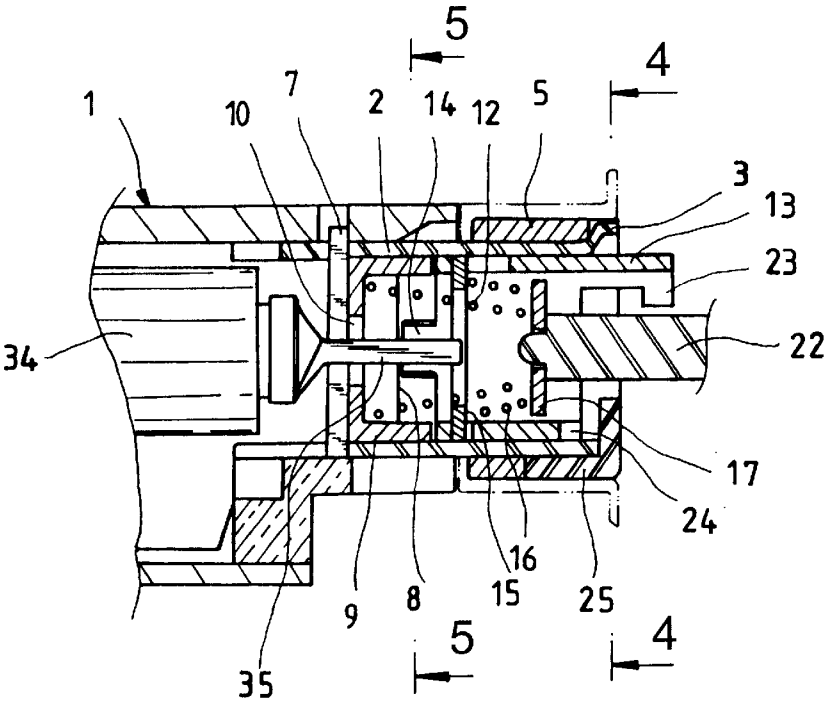
FIG. 3 is a cross-sectional view of the main parts showing the operating state (locking state) of the present invention.

Reference will now be made in detail to the preferred embodiments of the present invention, examples of which are illustrated in the accompanying drawings.

A spindle 2 inserted into an outside lever 1 has a plurality of projections 3 on its front end, and a bushing 5 has grooves 4 on its front end and a key groove 6 on one side thereof. The spindle 2 is inserted into the bushing 5 to make the projections 3 and grooves engage with each other.

An inside inner spindle 9 includes two fitting grooves 8 to reach a lever fixing key 7, and an aperture 10 to rotate together with a key 11 which is fitted in the outside lever 1 and then turned. The inside inner spindle 9 is inserted into the spindle 2, and then a locking spring 12 is inserted. Subsequently, an inside outer spindle 13 is inserted, spaced a short distance away from the inside inner spindle 9.

A spindle spring 16 supported by a support washer 15 is inserted into the inside outer spindle 13 having two fitting projections 14 on its front end, and an operation disk 17 is then inserted to fix the spindle spring 16. On both sides of the operation disk 17 are formed two guide projections 18 to be inserted into guide apertures 19 of the inside outer spindle 13.

The operation disk 17 also has a hole 20 in the center thereof, into which the end of a locking shaft 22 connected to a locking button 21 of the inside lever 1*a* is inserted. An L-shaped operation key 25 is inserted into the key groove 6 of the bushing 5 so that the end of the operation key 25 is inserted into an operation groove 24 which is opposite to a latch operation projection 23 of the inside outer spindle 13.

Reference numerals appearing in the drawings denote the following reference parts:

30—inside spindle; 31—latch operation projection of inside spindle; 32—latch bolt; 33—latch bolt operation cylinder; 34—key box; 35—operation shaft of key box; 36—inside plate; and 36'—outside plate The following description relates to the operation of the present invention constructed above.

When an inside lever 1*a* is turned to open the door from the inside, a latch operation projection 31, formed at the end of an inside spindle 30, makes a latch bolt 32 move backward to open the door. When the outside lever 1 is turned to open the door from the outside, the spindle 2 whose projections 3 are fitted in the grooves 4 of the bushing 5 also rotates. The rotation of the bushing 5 enables the operation key 25, inserted into the key groove 6, to rotate. The inside outer spindle 13 whose operation groove 24 is coupled to the front end of the operation key 25, rotates, too. Accordingly the latch bolt 32 is driven by the latch operation projection 23 formed at the end of the inside outer spindle 13, so that the door is opened.

When the locking button 21 is pressed from the inside under the condition, the following operation is performed. The locking shaft 22 moves forward, pushing the operation disk 17 coupled to the front end thereof. Subsequently, the whole inside outer spindle 13 is pushed to the inside, so that the fitting projections 14 of the inside outer spindle 13 are inserted into the fitting grooves 8 of the inside inner spindle 9, and thus making the operation groove 24 get out of the operation key 25.

When the outside lever 1 is turned at this point, it cannot operate the latch bolt 32, running idle. That is because the inside outer spindle 13 which is fitted in the operation key 25 and then rotates together with the spindle 2, is inserted into the spindle 2 and is not fitted in the operation key 25 thereby.

When the inside lever 1*a* is turned, the latch operation projection 31 formed at the front end of the inside spindle 30 makes the latch bolt 32 move backward to open the door, and simultaneously with this, the locking shaft 22 moves backward to release the locking.

The key 11 is employed to release the locking from the outside. If the key is turned at a specified angle, an operation shaft 35 of a key box 34 rotates the inside inner spindle 9 so that the inside outer spindle 13 fitted in the fitting groove 8 also rotates to operate the latch bolt 32.

Accordingly, the two separate inside spindles 9 and 13 within the spindle 2 of the outside lever 1 go into action with a clutch, so that the lever 1*a* runs idle from the outside at the time of locking, which prevents reduction of the life of the door lock that may result from the lever's excessive operation. In addition, the inside outer spindle operates, moving along the inside of the spindle 2, to thereby ensure the more exact and secure locking performance than the above-mentioned prior application.

It will be apparent to those skilled in the art that various modifications and variations can be made in a door lock of the present invention without departing from the spirit or scope of the invention. Thus, it is intended that the present invention cover the modifications and variations of this invention provided they come within the scope of the appended claims and their equivalents.

What is claimed is:

1. A door lock comprising: a spindle with projections; a bushing having grooves which mate with the projections of the spindle and a key groove on one side thereof; an inside inner spindle with two fitting grooves, which is inserted into the spindle and rotates by an operation shaft of a key box; a locking spring which is inserted into the inside inner spindle; an inside outer spindle which is inserted into the spindle spaced a short distance from the inside inner spindle, having two guide apertures, a latch operation projection with an operation groove, and two fitting projections on its front end, which are fitted in the fitting grooves; a support washer which is inserted into the inside of the inside outer spindle; a spindle spring which is supported by the support washer; an operation disk with two guide projections which are inserted into the guide apertures of the inside outer spindle; and an operation key which is inserted into the key groove of the bushing so that its front end is inserted into the operation groove of the inside outer spindle.

* * * * *